United States Patent [19]

McFarlin

[11] 4,207,746

[45] Jun. 17, 1980

[54] CRYOPUMP

[75] Inventor: David J. McFarlin, Ellington, Conn.

[73] Assignee: United Technologies Corporation, Hartford, Conn.

[21] Appl. No.: 11,833

[22] Filed: Feb. 13, 1979

[51] Int. Cl.[2] ..... F17C 7/02

[52] U.S. Cl. ..... 62/55.5; 55/269; 417/901

[58] Field of Search ..... 62/55.5, 100, 268; 55/269; 417/901

[56] References Cited

U.S. PATENT DOCUMENTS

| | | | |
|---|---|---|---|
| 3,131,396 | 4/1964 | Santeler et al. | 62/55.5 |
| 3,137,551 | 10/1964 | Mark | 55/269 |
| 3,175,373 | 3/1965 | Holkeboer et al. | 62/55.5 |
| 3,252,652 | 5/1966 | Trendelenburg et al. | 62/55.5 |
| 3,256,706 | 6/1966 | Hansen | 62/55.5 |
| 3,338,063 | 8/1967 | Hogan et al. | 62/55.5 |
| 3,364,654 | 1/1968 | Westbrook | 62/55.5 |
| 3,433,297 | 3/1969 | Kohler | 62/55.5 |

*Primary Examiner*—Ronald C. Capossela

*Attorney, Agent, or Firm*—Lawrence A. Cavanaugh

[57] ABSTRACT

A cryopump having a cryopanel adapted for being cooled by a first refrigerant and shielded from radiation incident thereon by shields adapted for being cooled with a second refrigerant is disclosed. The cryopanel and the radiation shield are fabricated with a first material having high thermal conductivity, such as aluminum, while means for distributing refrigerant from refrigerant dewars to the cryopanel and shields are made of a second material, such as stainless steel. The stainless steel and aluminum sections are connected by an aluminum-steel transition connector adapted for providing vacuum tight connections at cryogenic temperatures. Both the cryopanel and chevrons comprising the shields are fabricated and extruded aluminum with coolant passages formed therein. Thermal distortions during operation are compensated by the use of stainless steel bellows within refrigerant distribution lines. Additionally the refrigerant distribution lines are utilized to suspend the cryopanel and shields within an evacuated environment of the cryopump.

13 Claims, 2 Drawing Figures

CRYOPUMP

BACKGROUND OF THE INVENTION

The Government has rights in this invention pursuant to Contract (or Grant) No. EY-76-C-02-2277 awarded by the Department of Energy.

This invention relates to cryopumps and more particularly to a shielded cryopump emmploying dissimilar metals.

Shielded cryopumps having cryopanels adapted for condensation or adsorptive pumping surfaces cooled by liquid or cold gaseous hyrogen or helium and shielded from radiation by chevron panels adapted for providing gas paths therethrough while shielding the cryopanel from radation are well known in the art. In a typical shielded cryopump, the cryopanel is operated at twenty degrees Kelvin or less. The cryopanel is typically suspended within an evacuated environment from a liquid nitrogen shield with supports having low thermal conductivity such as stainless steel. The shields, typically liquid nitrogen cooled, have a chevron construction which shields the pumping surfaces from radiation while providing gas paths therethrough for efficient pumping operation. In the prior art devices the entire cryopump assembly including the cryopanel and the shield are fabricated of a single material having high thermal conductivity such as aluminum or copper, thereby avoiding welding problems associated with welding dissimilar metals intended for use at cryogenic temperatures. Additionally, the cryopanels are formed by welding or brazing coolant tubes to panels for providing good thermal conduction between the refrigerant and the pumping surfaces. The radiation shields are typically fabricated in a similar manner wherein coolant tubes are welded or brazed to the individual chevrons within the shield, typically at the apex of the chevron. The fabrication costs for constructing cryopumps in this manner are typically high. Additionally, the large number of welds required in the fabrication of the part results in a high probability that some of the welds will not be vacuum tight.

In prior art devices the refrigerant inlet and return lines are directly coupled between the refrigerant dewars and the radiation shields and the cryopanels. The utilization of a single material such as aluminum precluded the utilization of expansion bellows or the like within the cryopump to compensate for mechanical distortions due to thermal elongation and contraction during operation. This necessitated more complex configurations of the inlet and return lines to allow for thermal contraction at cryogenic temperatures.

SUMMARY OF THE INVENTION

An object of the present invention is to provide a cryopump having high reliability and low fabrication costs.

In accordance with the present invention a cryopump adapted for use in an evacuated environment comprises a cryopanel having a plurality of coolant passages disposed therein adapted for accommodating a first refrigerant, first manifold means for distributing a first refrigerant to each of the coolant passages wherein the first manifold means and the cyropanel are fabricated with a first material having high thermal conductivity, means for passing first refrigerant from a source of first refrigerant to the first manifold means wherein the means for passing first refrigerant are fabricated with a second material, a first shield disposed in a spaced apart relationship with a first side of the cryopanel, a second shield disposed in a spaced apart relationship with a second side of the cryopanel wherein the first and second shields, each have a plurality of chevrons disposed in a spaced apart relationship with one another, are adapted for shielding the cryopanel from line-of-sight radiation while providing a gas path between each chevron capable of passing gas particles therethrough to the cryopanel and wherein each chevron includes a coolant channel adapted for accommodating a second refrigerant, second manifold means for distributing second refrigerant to each of the coolant channels within the chevrons wherein the first and second shields and the second manifold means are fabricated with a first material having high thermal conductivity, means for passing second refrigerant from a source of second refrigerant to the second manifold means, wherein said means for passing second refrigerant are fabricated with a second material, and connector means for providing a vacuum tight connection between the dissimilar materials of the means for passing first and second refrigerant and the first and second manifold means respectively.

A primary feature of the present invention is the cryopanel fabricated with a plurality of plates. Each plate, preferably fabricated by an extrusion process, includes a coolant passage centrally disposed therein. Additionally the chevrons forming the first and second shields are also fabricated by an extrusion process and include a coolant channel disposed therein proximate an apex of each chevron. The plates and the chevrons are fabricated with material having high thermal conductivity, such as aluminum. The coolant channel within each chevron is fixedly connected by welding or the like to a manifold fabricated of material having high thermal conductivity, such as aluminum, which cooperates with the first and second shields to shield the cryopanel from radiation. Additionally, the means for passing first and second refrigerant is fabricated from a second material, such as stainless steel. Also, the connector means, adapted for joining dissimilar material such as aluminum and stainless steel, are utilized to form vacuum tight welds between the first and second manifolds and the means for passing first and second refrigerants respectively. Expansion means, such as stainless steel bellows, disposed within the means for passing first and second refrigerant, are adapted for providing flexible connections for minimizing strain resulting from thermal expansion and contraction during operation and for minimizing fabrication alignment tolerances.

An advantage of the present invention is the low cost of forming the extruded plates and chevrons. Additionally, the utilization of extruded parts minimizes the number of welds required to fabricate the cryopump thereby simplifying the construction and minimizing potential vacuum leaks in the welds. Additionally, the utilization of connectors adapted for joining dissimilar materials enables the cryopanel and shields to be fabricated of material having a high thermal conductivity while enabling the means for passing first and second refrigerant to be fabricated of stainless steel material, which is easier to weld. The utilization of flexible stainless steel bellows within the structure minimizes strain resulting from thermal distortion and misalignments.

The foregoing and other objects, features and advantages of the present invention will become more apparent in the light of the following detailed description of preferred embodiments thereof as discussed and illustrated in the accompanying drawing.

DESCRIPTION OF THE PREFERRED EMBODIMENT

Figure 1:
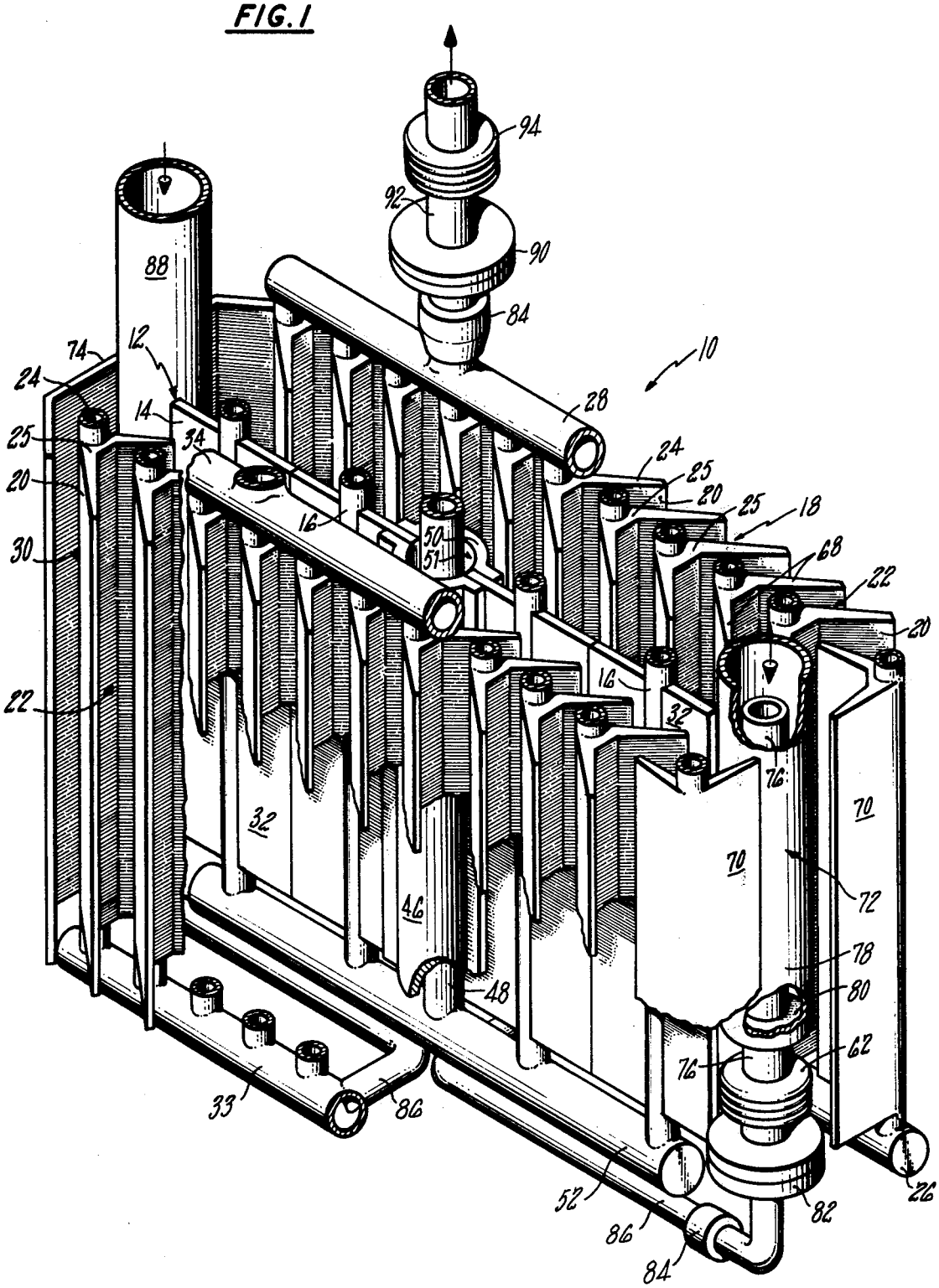
FIG. 1 is a simplified cutaway perspective view of a cryopump constructed in accordance with the present invention.

Referring now to FIG. 1 which shows a simplified perspective view of the cryopump 10 in accordance with the present invention. The cryopump includes a cryopanel 12 (which is shown in more detail in FIG. 2) fabricated with a plurality of plates 14 each having a coolant passage 16 centrally disposed therein, a first shield 18 disposed in a spaced apart relationship with a first surface (not shown) of the cryopanel and having a plurality of chevrons 20 disposed in a spaced apart relationship with one another to provide a gas path 22 between adjacent chevrons wherein each chevron includes a coolant channel 24 within the apex 25 of the chevron wherein the coolant channel is connected at one end of a first shield inlet manifold 26 and at the other end to a first shield exit manifold 28, and a second shield 30 substantially identical to the first shield 18 disposed in a spaced apart relationship with a second surface 32 of the cryopanel. The second shield also includes a second shield inlet manifold 33 and a second shield exit manifold 34, both substantially identical to the first shield inlet and first shield exit manifolds 26, 28 respectively. The first and second shield inlet and exit manifolds provide structural support to maintain the individual chevrons 20 in the spaced apart relationship to provide the gas paths 22 therebetween. The cryopanel and shields are connected to sources of first and second refrigerant as hereinafter described.

Figure 2:
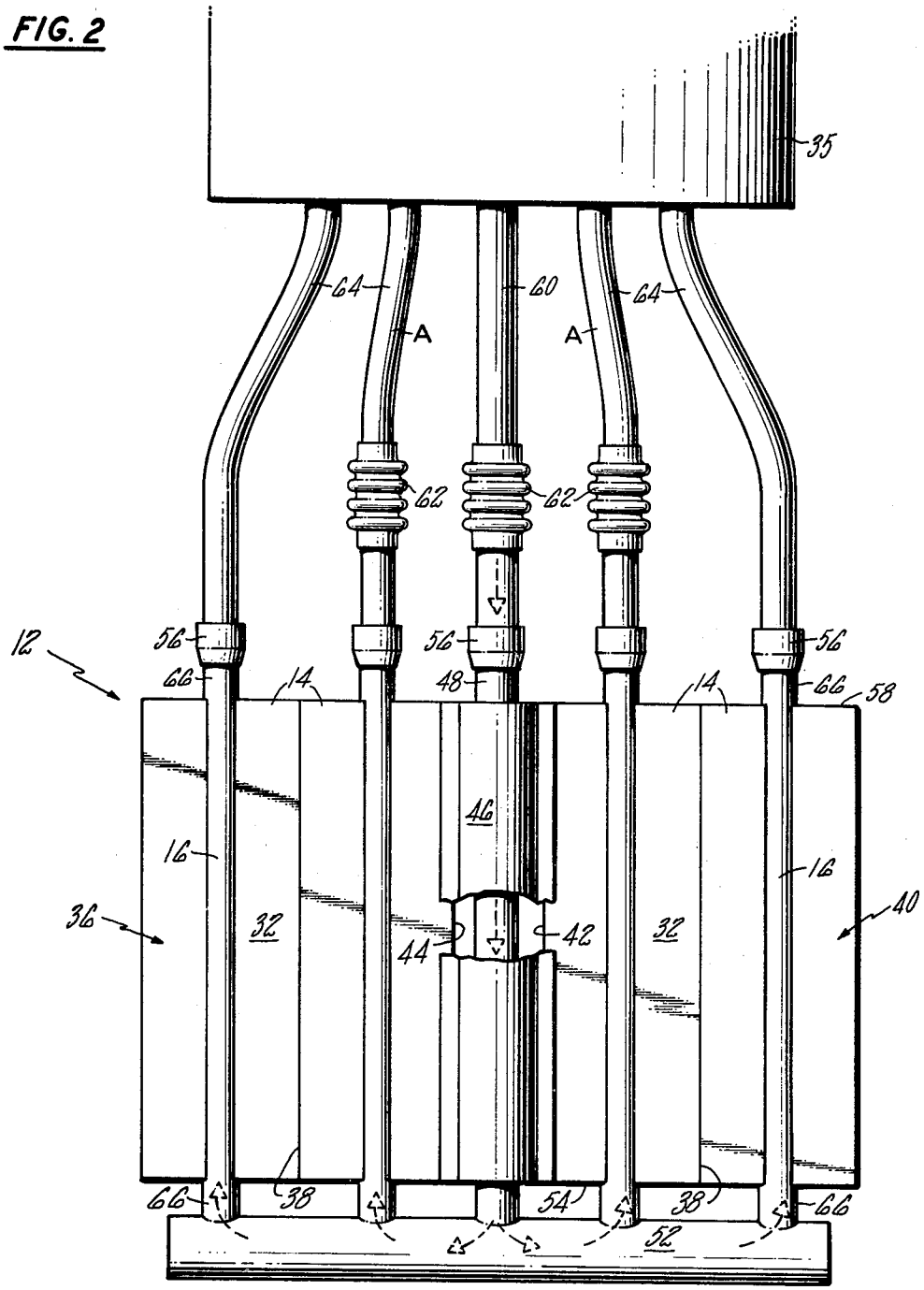
FIG. 2 is a simplified view of the cryopanel portion of the cryopump shown in FIG. 1.

Referring now to FIG. 2 which shows a simplified side view of the cryopanel 12 and its connection to a source 35 of first refrigerant such as a liquid helium dewar. In the preferred embodiment the cryopanel is fabricated having two sections. A first section 36 formed with two plates 14 which are butted together forming a junction 38 therebetween. The plates may be fixedly attached at the junction as by welding, brazing or the like or they may have their positional relationship maintained in either a spaced apart or contacting relationship as hereinafter described in more detail. A second section 40, substantially identical to the first section, has a first edge 42 disposed in a spaced apart relationship to a second edge 44 of the first section. The first and second sections 36, 40 respectively, are joined together on the second surface 32 by a first cover plate 46, having a curvilinear configuration adapted for partially enclosing a coolant inlet pipe 48 disposed between the first and second edges 42, 44 respectively.

The first cover plate is fixedly attached to the second surface 32 of both sections by welding, bolts or the like to obtain good thermal contact therebetween. A second cover plate 50, as shown in FIG. 1, substantially identical to the first cover plate fixedly connects the first surface (not shown) of the first and second sections in a substantially identical manner as the first cover plate forming a passage 51, as shown in FIG. 1, therebetween adapted for accommodating the coolant inlet pipe. Preferably the coolant inlet pipe is maintained within the passage in good thermal contact with the first and second cover plates and with the first and second side edges 42, 44. The first and second cover plates cooperate with the first and second surfaces to provide condensation or adsorptive pumping surfaces of the cryopump.

The coolant inlet pipe 48, extending through the passage 51 in the cryopanel, is attached at one end to a panel manifold 52 positioned proximate the bottom 54 of the cyropanel and at the other end to a connector 56 proximate the top 58 of the cryopanel. The connector 56, such as a Bi-Braze™ connector produced by Bi-Braze Corporation, is adapted for providing a vacuum tight connection between the coolant inlet pipe and a supply line 60 connecting the source 35 of first refrigerant to the cryopanel. A flexible bellows 62 is disposed within the supply line to provide a means for compensating thermal expansion and contraction of the cryopump during operation.

The coolant passages 16 of each of the panels 14 are connected to the panel manifold 52 proximate the bottom 54 of the cryopanel by welding, brazing or the like forming a vacuum tight connection therebetween. The coolant passages are also attached to connectors 56, as noted hereinbefore, proximate the top 58 of the cryopanel for providing vacuum tight connectors between the coolant passages and return lines 64 adapted for returning first refrigerant to a receiving port (not shown) in the source of first refrigerant. The source of first refrigerant 35 is constructed in accordance with principals well known in the art and may be adapted for providing first refrigerant to the cryopanel in either an open cycle or closed cycle manner as is well known in the art.

As shown in FIG. 2, a portion of the return lines 64 include bellows 62 for providing compensation for thermal distortions during operation and a portion have rigid structures for providing support to hold the cryopanel with an evacuated environment of the cryopump and to maintain the alignment of the plates forming the cryopanel. In the preferred embodiment the return lines, designated A in FIG. 2, proximate the inlet pipe and include bellows.

In the preferred embodiment the plates 14 are made of extruded aluminum with the coolant passages formed therein during the extrusion process. The top and bottom of the plates are typically machined by means well known in the art to form protrusions 66 adapted for connecting the coolant passages to the panel manifold 52 and the connectors 56. The panel manifold 52 and the coolant inlet pipe 48 are also constructed of aluminum. The return lines 64, supply line 60 and the bellows are fabricated of stainless steel and the connectors are adapted for connecting stainless steel to aluminum. It is to be recognized that although the preferred configuration as shown in FIG. 2 is shown having four plates 14, the total number of the plates and the number of inlet pipes disposed between plates will be determined by the pumping requirements of the cryopump. The dimensions of the plates will be determined by the heat transfer characteristics of the plates and the pumping requirement of the cyropump by means well known in the art.

The plates are rigidly connected to the panel manifold thereby providing a support structure for maintaining the alignment and positioning of the plates relative to one another. The rigid connection of a portion of the return lines between the cryopanel and the source 35 of the first refrigerant provide additional support for maintaining the relative positioning of the plates.

Referring again to FIG. 1, each of the chevrons 20 forming the first and second shields 18, 30 have a pair of fins 68 extending from the apex 25 and angularly disposed to one another. The fins in adjacent chevrons cooperate with one another to shield the condensation or adsorptive pumping surfaces of the cryopanel from radiation while providing a gas path 22 between each chevron to enable gas particles to flow therethrough for collection at the condensation surfaces. The end chevron 70 is angularly disposed to a stacking line (not shown) of the chevrons such that one fin is disposed between the pair of fins of the adjacent chevron preferably bisecting the angle therebetween while the other fin cooperates with a first fill tube 72 disposed proximate one end of the cryopanel to provide additional radiation shielding of the cryopanel. A protector shield 74 disposed on shield ends opposite the end chevron 70, provides additional radiation shielding of the cryopanel.

The first fill tube 72 includes an inner tube 76 symmetrically disposed within an outer tube 78. The outer tube is sealed at a bottom 80 to provide a reservoir for refrigerant around the inner tube. The inner and outer tubes are formed of stainless steel with the outer tube adapted for connection to a source of second refrigerant (not shown) such as liquid nitrogen. The inner tube extends through the bottom of the outer tube and is attached to bellows 62 as hereinbefore noted. The bellows are connected to a stainless steel flange 82 which in turn is connected to connectors 84 substantially identical to connectors 56 utilized on the cryopanel. The connectors 84 provide a vacuum tight connector between the stainless steel first fill tube 72 and a source pipe 86 fabricated of aluminum positioned below and proximate to the panel manifold 52, effectively providing radiation shielding to essentially one half of the bottom of the cryopanel. The source pipe extends from the connector 84 under approximately one half of the panel manifold to where it is angled for connection to the first shield inlet manifold. A second fill pipe 88 substantially identical to the first fill pipe 72 is disposed between the protector shield 74 and the cryopanel and is connected to the second shield inlet manifold in a substantially identical manner as the first fill pipe 72 is connected to the first shield inlet manifold.

The first shield exit manifold 28 is connected to a stainless steel flange 90 with a connector 84 as shown in FIG. 1. It is to be recognized that the second shield exit manifold is similarly connected to a flange. The first and second shields, chevrons, inlet and exit manifolds and the source pipes are all made of aluminum. The flange 90 is connected to a source refrigerant (not shown) by a return line 92. Bellows 94 are located in the return line for thermal distortion compensation. The shields are connected to the source of second refrigerant by flanges to facilitate the removal of the shield for inspection and/or repair and for easy access to the cryopanel for inspection and/or repairs. Due to the nature of liquid helium, the cryopanels must be hard sealed as by welding or brazing to the source of first refrigerant. In the preferred embodiment the chevrons are fabricated of extruded aluminum with the coolant channels integrally disposed therein.

In operation a second refrigerant such as liquid nitrogen is provided to the shields in either a closed or open cycle by means well known in the art. Once the shields have obtained a temperature substantially equal to the temperature of the second refrigerant, a first refrigerant, such as liquid helium, is supplied to the cryopanel in either an open or closed cycle by means well known in the art and the cryopump is operated in a manner substantially identical with prior art devices with the exception that the bellows provide a flexible coupling to compensate for thermal distortion of the shield and cryopanel. The use of aluminum-stainless steel connectors allows the utilization of aluminum for the cryopanel and shields and stainless steel for the supply lines to the cryopanel and shields. Aluminum extrusions, which are easy and inexpensive to form, allow a significant reduction in the number of welds required to fabricate the parts. Additionally the aluminum provides good thermal conductivity for maintaining the cryopanel at a substantially uniform cryogenic temperature substantially equal to the temperature of the first refrigerant and for maintaining the chevrons at a substantially uniform temperature substantially equal to the temperature of the second refrigerant. The use of connectors allows the fill and return pipes to be fabricated of stainless steel for relatively easy fabrication and welding and the use of stainless steel expansion bellows. Reliable operation is not obtainable with expansion bellows fabricated of aluminum. It is to be recognized that the top of the cryopanel must also be shielded from radiation for efficient operation of the cryopump.

Although this invention has been shown and described with respect to a preferred embodiment thereof, it should be understood by those skilled in the art that various changes and omissions in the form and detail thereof may be made therein without departing from the spirit and scope of the invention.

Having thus described a typical embodiment of my invention, that which I clam as new and desire to secure by Letters Patent of the United States is:

1. A cryopump adapted for use in an evacuated environment comprising:

a cryopanel having a plurality of coolant passages disposed therein adapted for accommodating a first refrigerant;

first manifold means for distributing a first refrigerant to each of the coolant passages wherein the first manifold means and the cryopanel are fabricated with a first material having high thermal conductivity;

means for passing first refrigerant from a source of first refrigerant to the first manifold means wherein the means for passing first refrigerant are fabricated with a second material;

a first shield disposed in a spaced apart relationship with a first side of the cryopanel;

a second shield disposed in a spaced apart relationship with a second side of the cryopanel wherein the first and second shields, each have a plurality of chevrons disposed in a spaced apart relationship with one another, are adapted for shielding the cryopanel from line-of-sight radiation while providing a gas path between each chevron capable of passing gas particles therethrough to the cryopanel and wherein each chevron includes a coolant channel adapted for accommodating a second refrigerant;

second manifold means for distributing second refrigerant to each of the coolant channels within the chevrons wherein the first and second shields and the second manifold means are fabricated with a first material having high thermal conductivity;

means for passing second refrigerant from a source of second refrigerant to the second manifold means wherein said means for passing second refrigerant are fabricated with a second material; and connector means for providing a vacuum tight connection at cryogenic temperatures between the second material of the means for passing first and second refrigerant and the first material of the first and second manifold means respectively.

2. The invention in accordance with claim 1 wherein the cryopanel includes a plurality of plates wherein each plate includes at least one of the coolant passages.

3. The invention in accordance with claim 2 wherein the plates are fabricated of extruded first material with the coolant passages formed integral therewith.

4. The invention in accordance with claim 3 wherein the chevrons are fabricated of extruded first material with the coolant channel formed integral therewith.

5. The invention in accordance with claim 4 wherein the first material is aluminum.

6. The invention in accordance with claim 5 wherein the second material is stainless steel.

7. The invention in accordance with claim 6 wherein the connector means is a connector adapted for providing a vacuum tight connection between aluminum and stainless steel.

8. The invention in accordance with claim 1 wherein the means for passing first refrigerant includes at least one supply line fixedly attached at one end to a source of first refrigerant and fixedly attached at the other end to the connector means and a plurality of return lines fixedly attached at one end to connector means and fixedly attached at the other end to a return port within the source of first refrigerant.

9. The invention in accordance with claim 8 further including a bellows disposed within the supply line adapted for providing compensation for the thermal expansion and contraction of the cryopump.

10. The invention in accordance with claim 8 wherein a portion of the return lines includes bellows adapted for compensating for thermal expansion and contraction of the cryopump while a remaining portion of the return lines are adapted for rigidly connecting the cryopanel to the source of first refrigerant for providing structural support of the cryopanel.

11. The invention in accordance with claim 1 wherein the means for passing second refrigerant includes at least one fill tube disposed between the source of second refrigerant and an inlet manifold of the shield and at least one return line disposed between the source of second refrigerant and an exit manifold of the shield.

12. The invention in accordance with claim 11 further including a bellows disposed between the fill tube and the inlet manifold of the shield and between the return line and the exit manifold of the shield for providing compensation for thermal expansion and contraction of the cryopump.

13. The invention in accordance with claim 12 further including flanges disposed between the fill tube and the bellows and between the return lines and the bellows adapted for releasably attaching the shields to the source of second refrigerant for repair and/or maintenance of the chevron and/or inspection or repair of the cryopanel.

* * * * *